US005370554A

United States Patent [19]

Koyasu

[11] Patent Number: 5,370,554

[45] Date of Patent: Dec. 6, 1994

[54] CIRCUIT BOARD CONNECTOR

[75] Inventor: Ryo Koyasu, Shizuoka, Japan

[73] Assignee: Yazaki Corporation, Tokyo, Japan

[21] Appl. No.: 87,412

[22] Filed: Jul. 8, 1993

[30] Foreign Application Priority Data

Jul. 8, 1992 [JP] Japan ..... 4-203210

[51] Int. Cl.[5] ..... H01R 13/40

[52] U.S. Cl. ..... 439/595; 439/83

[58] Field of Search ..... 439/33, 78, 79, 82, 439/83, 161, 595, 603, 744, 871, 873, 883

[56] References Cited

U.S. PATENT DOCUMENTS

| | | | |
|---|---|---|---|
| 4,826,453 | 5/1989 | Glomb et al. | 439/744 X |
| 4,923,405 | 5/1990 | Munsterman et al. | 439/78 |
| 4,941,847 | 7/1990 | Welsh | 439/595 |
| 5,076,796 | 12/1991 | Kusayanagi et al. | 439/83 |

FOREIGN PATENT DOCUMENTS 51-151994 12/1976 Japan .

*Primary Examiner*—Khiem Nguyen

*Attorney, Agent, or Firm*—Jacobson, Price, Holman & Stern

[57] ABSTRACT

A circuit board connector for improving the reliability in the electrical connection of a joint section between a circuit board and a terminal, includes a housing and a pair of flexible arms extending downwards in the housing and adapted to lock a connection terminal with the housing, a slit-like gap being provided between the two flexible arms, semi-ellipsoidal engagement protrusions being provided on the arms at positions where they are opposed to each other. The connection terminal has a substantially rhombic engagement hole which is to be engaged with the engagement protrusions. When the flexible arms in the housing undergo thermal expansion as a result of a rise in temperature, the engagement protrusions move downwards while remaining in abutment with oblique inner edges of the engagement hole, thereby absorbing dimensional changes of the housing. Thus, the terminal is not influenced by expansion/contraction of the housing, thereby ensuring a stable electrical connection without involving any damage to the joint section between the circuit board and the terminal.

9 Claims, 8 Drawing Sheets

CIRCUIT BOARD CONNECTOR

BACKGROUND OF THE INVENTION:

1. Field of the Invention

This invention relates to a connector for connecting a connection wire to a printed circuit board and, in particular, to a circuit board connector which prevents a terminal connecting section on a printed circuit board from being damaged by expansion/contraction of the housing of the connector when this housing, into which a terminal has been inserted, expands or contracts as a result of a temperature change .

2. Description of the Related Art

Japanese Utility Model Laid-Open No. 51-151994 discloses a conventional connector for connecting a connection wire to a circuit board, which connector is shown in FIG. 9. Referring to FIG. 9, a connector B includes housing 10 and a terminal 12 inserted into the housing, the terminal 12 having a raised engagement element 12*a*, which is engaged with an engagement step 15*a* in an engagement section 15 of the housing body 10. The terminal 12 further includes a connecting section 12*b*. As indicated at 6 in FIG. 9, connection of the connector B to a printed circuit board 3 is effected by soldering the connecting section 12*b*, which extends through the circuit board, to the printed circuit board 3.

Referring to FIG. 10, which is an enlarged view of the essential part of the connector B, the housing 10 is made of resin (polypropylene or the like), whereas the terminal 12 is made of a conductive material (a metal belonging to the copper family). Thus, the housing 10 and the terminal 12 exhibit different coefficients of thermal expansion. Here, the coefficient of thermal expansion of the terminal 12 may be neglected since it is much smaller than that of the housing 10. When the housing 10 expands as a result of a sudden rise in temperature caused by a soldering bath or the like, the engagement step 15*a* of the engagement section 15 expands by a length d1 to be changed into an engagement step 15*b* as shown in the drawing. As a result of this change, the engagement element 12*a* of the terminal 12 is pushed upwards by the length d1. This causes the connecting section 12*b* of the terminal 12, which is engaged with the engagement step 15*a*, to be likewise raised by d1. As a result, concentration of stress occurs at the soldered section 6 joining the connecting section 12*b* of the terminal to the circuit board 3, thereby causing damage such as cracks or distortion, which may lead to a considerable degree of deterioration in the reliability of the electrical connection.

Thus, the above-described conventional engagement method, in which the housing and the terminal, made of materials having greatly different coefficients of thermal expansion, are simply engaged with each other, has the problem that a sudden temperature change caused by the soldering bath or the like may cause expansion or contraction of the housing, resulting in the generation of cracks or the like in the soldered section joining the terminal to the circuit board. Further, it is possible for the engaging element of the terminal to be deformed as a result of distortion, or four the terminal to be detached from the circuit board, resulting in disconnection or poor conductivity.

The present invention has been made in view of the above problems in the conventional method for engaging the housing with the terminal. It is the object of the present invention to provide a circuit board connector which improves the reliability in the electrical connection of the joint section between the circuit board and the terminal.

SUMMARY OF THE INVENTION

In accordance with this invention, the above object is achieved by a circuit board connector of the type which includes a housing and a terminal having a connecting section which extends through a bottom of the housing to be soldered to a circuit conductor, the circuit board connector comprising: a pair of flexible arms arranged side by side within the housing with a space therebetween; a pair of engagement protrusions for locking the terminal which are respectively provided on one surface of each of the flexible arms at positions where they are opposed to each other, the terminal, which is engaged with the engagement protrusions, being provided with an engagement hole having at least a pair of oblique inner edges, the engagement protrusions being movable within the engagement hole while remaining in abutment with the oblique inner edges when the housing expands or contracts.

In accordance with the present invention, the pair of flexible arms, which have engagement protrusions, are laterally movable due to the gap provided therebetween and the elasticity thereof. When expansion/contraction of the housing occurs as a result of a change in temperature, the engagement protrusions of the flexible arms make a lateral movement simultaneously with the longitudinal expansion/contraction of the housing while remaining in abutment with the oblique inner edges of the engagement hole of the terminal. This lateral movement of the engagement protrusions absorbs the stress concentrated on the terminal connecting section on the circuit board as a result of the expansion/contraction of the housing, so that the terminal is not influenced by the expansion/contraction of the housing, thereby improving the reliability of the electrical connection between the terminal and the circuit board.

Other objects and advantages of the present invention will be better understood from the following detailed description taken in connection with the accompanying drawings.

DETAILED DESCRIPTION OF THE PREFERRED EMBODIMENTS

Figure 1:
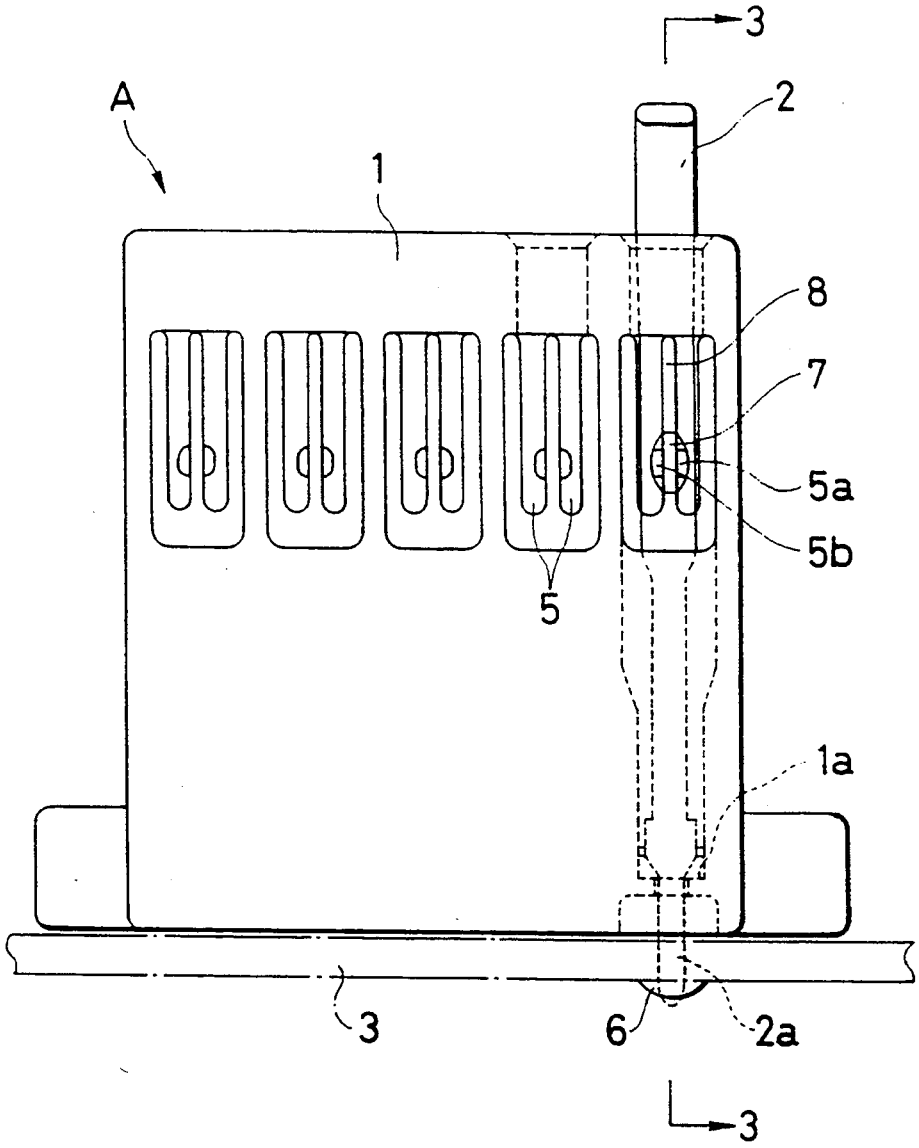
FIG. 1 is a front view of a connector according to an embodiment of this invention.
Figure 2:
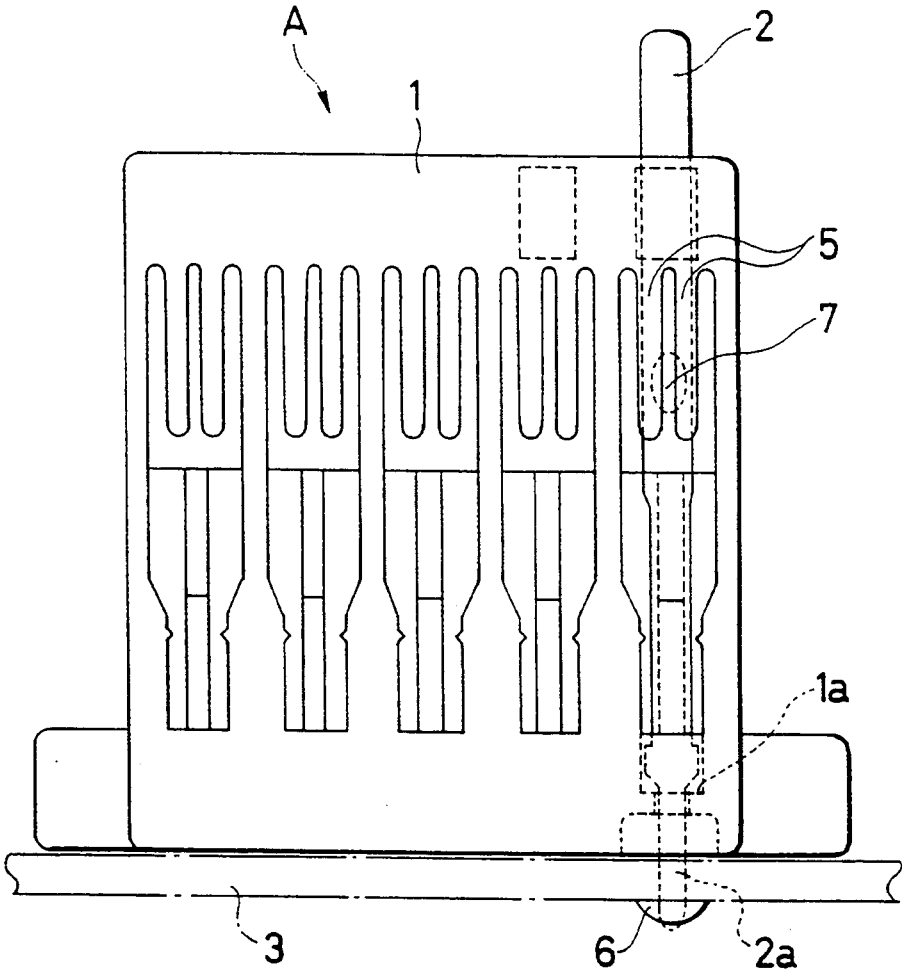
FIG. 2 is a back side view of FIG. 1.

Referring to FIG. 1, a connector A according to the present invention is composed of a resin housing 1 and a plurality of terminals 2 which are made of a conductor material and inserted into the housing 1. Each of the terminals 2 includes a connecting section 2*a* which extends through the bottom of the housing 1 so as to be connected to a printed circuit board 3, and another connecting section which protrudes upwardly beyond the housing 1 so as to be connected to other connectors. A plurality of pairs of flexible arms 5 are provided inside the housing 1 and extend vertically downwards within the housing 1. By means of these flexible arms 5, the housing 1 is engaged with the terminals 2. In each pair of flexible arms 5, a slit-like gap 8 is provided between the two flexible arms 5, and a pair of semi-ellipsoidal engagement protrusions 5*a* and 5*b* are respectively provided on the two flexible arms 5 at positions where they are opposed to each other. Each terminal 2 has a substantially rhombic engagement hole 7 which is to be engaged with the engagement protrusions 5*a* and 5*b*, the longitudinal center line of the terminal 2 intersecting the rhombic engagement hole 7 in such a way that the four sides of the rhombus are parted symmetrical with respect to this center line (see FIG. 4).

A stopper section 1*a* is provided in the lower section of the housing 1. Engagement holes (not shown) are formed in the circuit board 3 which is to be connected to connecting wires by means of the connector A. When the connector A is joined to the circuit board 3, the terminals 2 are first inserted from above into the housing 1 and engaged with the engagement protrusions 5*a* and 5*b*. Then, the connecting section 2*a* of each terminal 2, which protrudes beyond the bottom of the connector A, is fitted into a connecting hole of the circuit board 3. After the connector A has been secured onto the circuit board 3 by means of screws, the connecting section 2*a* of each terminal 2 is connected to a circuit conductor of the circuit board 3 by soldering, as indicated at 6.

Figure 3:
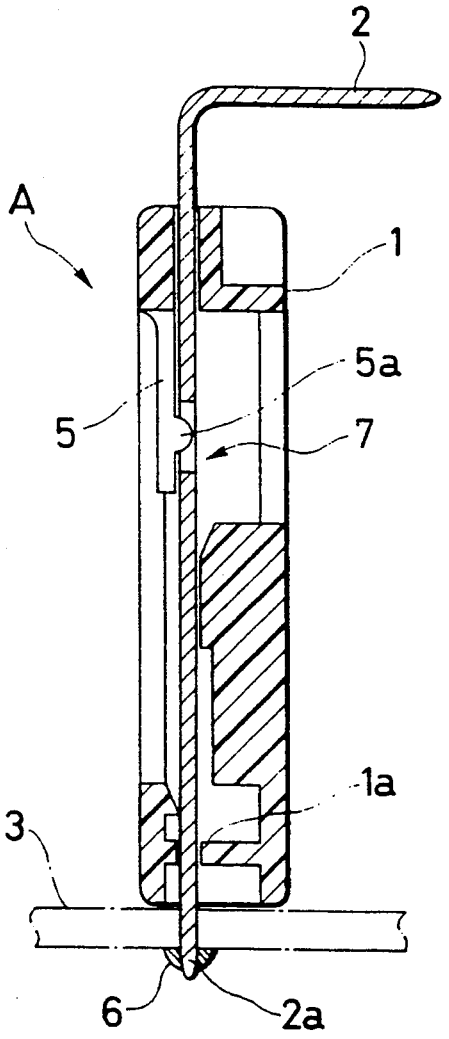
FIG. 3 is a sectional view taken on line 3—3 of FIG. 1.

Referring to FIG. 3, the above-mentioned pair of engagement protrusions 5*a* and 5*b*, which are provided on each pair of flexible arms 5 extending vertically downwards from the upper section of the housing 1 and having free end sections, are formed on those surfaces of the flexible arms 5 which face the terminal 2, and are adapted to be engaged with crossing-angle sections is 9*a* and 9*b* (see FIG. 4) of the engagement hole 7 of the terminal 2.

Figure 4:
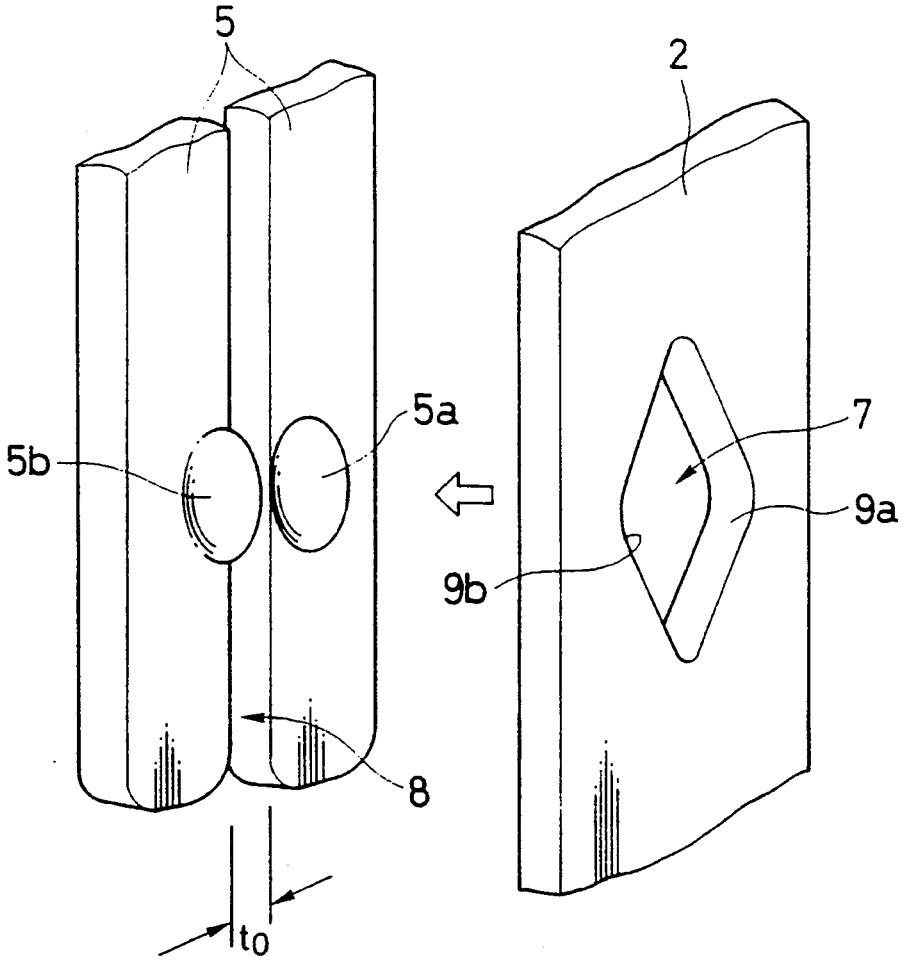
FIG. 4 is an enlarged perspective view showing an engagement hole and engagement protrusions on flexible arms in a connector.

Referring to FIG. 4, a slit-like gap 8 having a width to is defined between each pair of flexible arms 5, and the pair of semi-ellipsoidal engagement protrusions 5*a* and 5*b* are integrally formed on those surfaces of the pair of flexible arms 5 which face the terminal 2, at positions close to the above-mentioned gap 8. The engagement protrusions 5*a* and 5*b* are engaged with the crossing-angle sections 9*a* and 9*b* of the substantially rhombic engagement hole 7 provided in the terminal 2.

Figure 5:
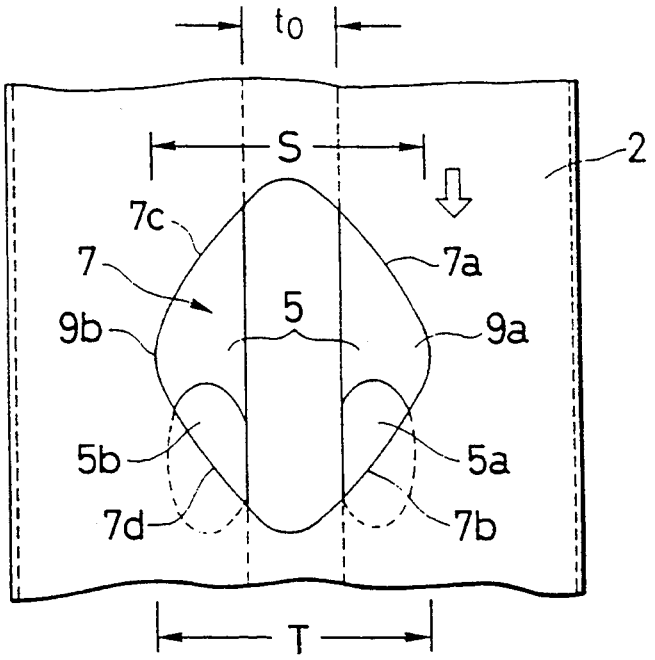
FIG. 5 is a diagram showing the condition in which the terminal has not been engaged with the flexible arms yet.
Figure 6:
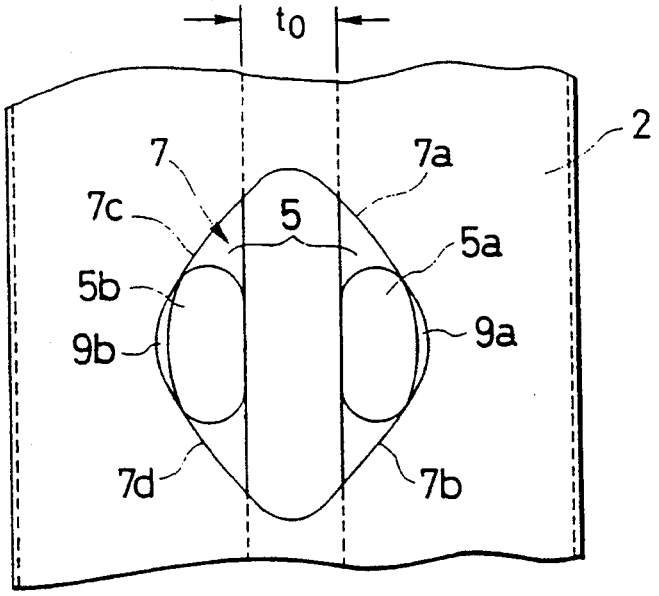
FIG. 6 is a diagram showing the condition in which the terminal has been engaged with the flexible arms.

As shown in FIG. 5, the terminal 2 has not been engaged with the flexible arms 5 yet, whereas in FIG. 6, the terminal 2 has been engaged with the flexible arms 5. The distance T between the outer side surfaces of the engagement protrusions 5*a* and 5*b* is made to correspond to the lateral dimension S of the engagement hole 7. Thus, when the terminal 2 is inserted into the housing 1, one engagement protrusion 5*a* is engaged with the crossing-angle section 9*a* defined by oblique inner edges 7*a* and 7*b* of the substantially rhombic hole 7, and the other engagement protrusion 5*b* is engaged with the crossing-angle section 9*b* defined by oblique inner edges 7*c* and 7*d* of the hole 7.

Figure 7:
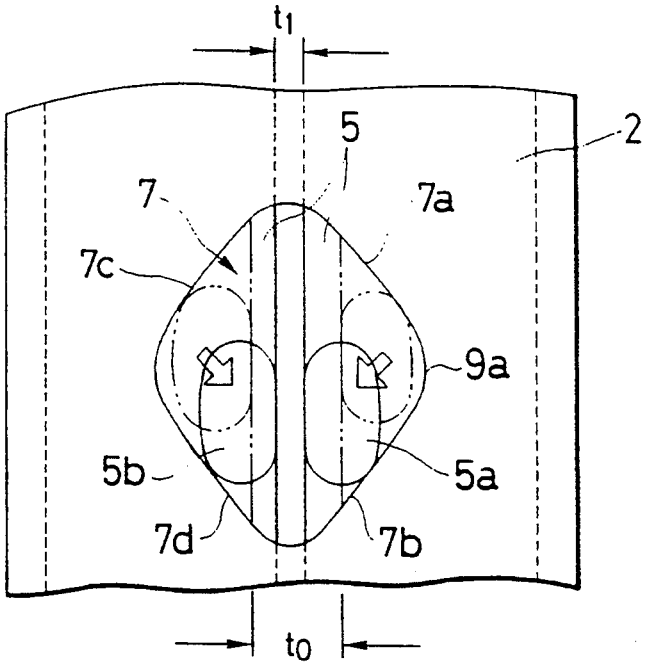
FIG. 7 is a diagram, showing the condition in which the housing has undergone thermal expansion.

As shown in FIG. 7, the housing A as shown in FIG. 6 has undergone thermal expansion as a result of a sudden rise in temperature caused by a soldering bath or the like. Such a thermal expansion causes the connector A, which is made of a resin material such as polypropylene, to expand to a much larger degree than the terminal 2, which is made of a metal material belonging to the copper family (given the same condition, the coefficient of thermal expansion $\beta 1$ of the resin material is always larger than the coefficient of thermal expansion $\beta 2$ of the metal material). Thus, in the condition in which the connector 1 has been joined to the circuit board 3, such a rise in temperature brings about the following change: as the housing 1 expands with the rise in temperature, the engagement protrusions 5*a* and 5*b* move downwards while remaining engaged with the oblique inner edges 7*b* and 7*d*, respectively, of the engagement hole 7. This downward movement absorbs the distortional stress, etc. generated as a result of the thermal expansion, so that the expansion of the housing 1 does not influence the terminal 2. During thermal expansion, the gap between the pair of flexible arms 5 exhibits a width t1 which is smaller than the width to thereof when there is no such temperature change. Due to this change in the gap width, the outward pressurizing force of the flexible arms 5 is augmented, so that in spite of the downward movement of the engagement protrusions 5*a* and 5*b* from the crossing-angle sections 9*a* and 9*b*, the terminal 2 remains firmly engaged with these engagement protrusions.

Conversely, when the housing 1 contracts as a result of a sudden temperature fall, the engagement protrusions 5*a* and 5*b* move upwards while remaining in abutment with the oblique inner edges 7*a* and 7*b* of the engagement hole 7. This upward movement absorbs the distortional stress, etc. generated by the contraction, thereby preventing the terminal 2 from being influenced by the contraction of the housing 1. Further, since the flexible arms 5 exert their outward pressurizing force due to the resiliency thereof while abutting the inner oblique edges 7*a* and 7*b*, the terminal 2 can remain firmly engaged with the housing 1.

Figure 8:
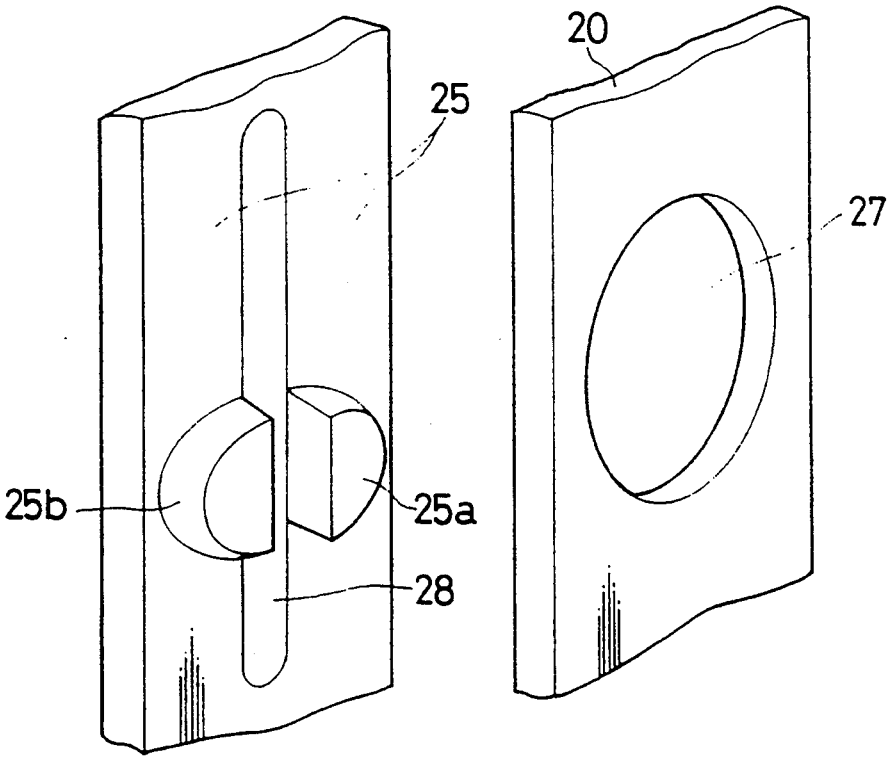
FIG. 8 is a perspective view of another embodiment of this invention.
Figure 9:
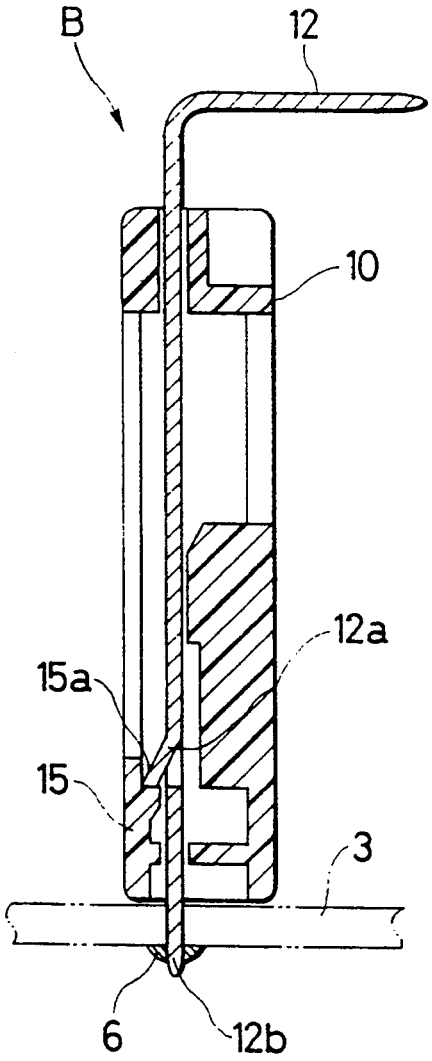
FIG. 9 (PRIOR ART)
FIG. 9 is a sectional view of a conventional connector.
Figure 10:
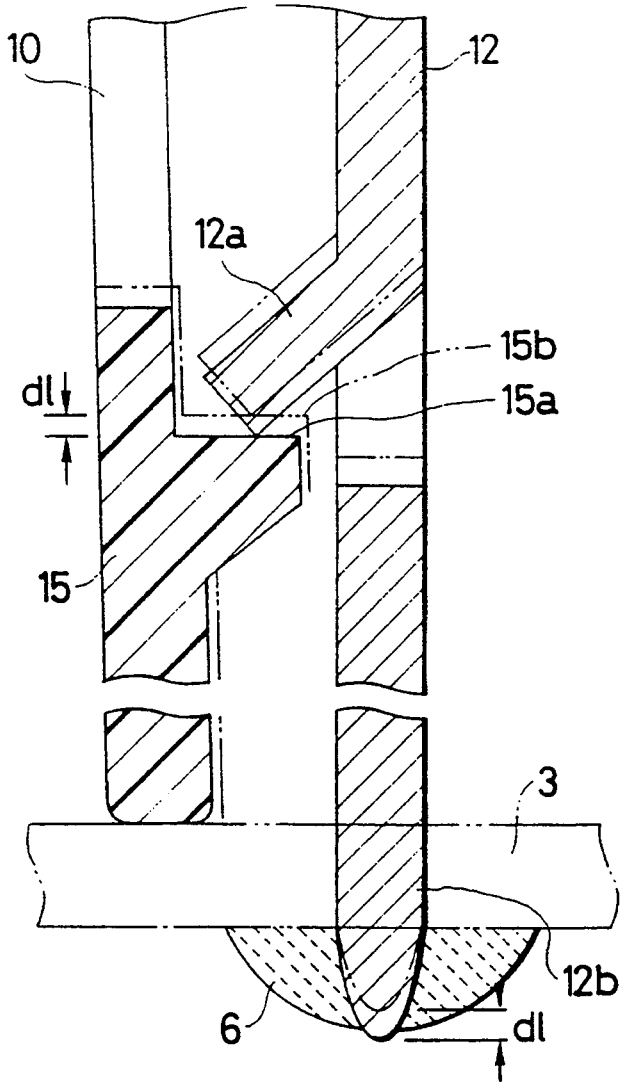
FIG. 10 (PRIOR ART)
FIG. 10 is an enlarged view of FIG. 9.

The present invention is not restricted to the embodiment as described above. FIG. 8 shows another embodiment of this invention. Referring to the drawing, a terminal 20 has an engagement hole 27 whose configuration may be elliptical, circulars or triangular. Further, engagement protrusions 25*a* and 25*b* each may exhibit a semicircular sectional configuration, as shown in the drawing, or a triangular one. In addition, the flexible arms are not limited to the cantilever-type ones as described above. It is also possible, as shown in FIG. 8, to form them as a center-type flexible arm 25 having a slit 28 as shown in the drawing and a pair of engagement protrusions 25*a* and 25*b* opposed to each other on each side of the slit.

As described in detail above, in accordance with the present invention, the terminal is not affected by expansion/contraction due to a sudden temperature change, so that damage to the joint section between the circuit board and the terminal or distortion of the terminal can be avoided, thereby making it possible to ensure a stable electrical connection.

What is claimed is:

1. A circuit board connector comprising:

a housing;

at least one terminal member for insertion into said housing and suitable for connection to a circuit board;

flexible terminal locking means provided inside and formed integrally with said housing and having first engagement means; and second engagement means provided on said terminal member and adapted to engage said first engagement means of said flexible terminal locking means, said flexible terminal locking means being laterally movable in response to longitudinal movement caused by expansion or contraction of said housing, said second engagement means being formed so as to remain engaged with said first engagement means during movement of said flexible terminal locking means.

2. A circuit board connector according to claim 1, wherein said flexible terminal locking means includes at least a pair of flexible arms arranged side by side with a gap therebetween, and said first engagement means comprising engagement protrusions respectively provided on said pair of flexible arms at positions opposed to each other, said second engagement means comprises an engagement hole having at least a pair of oblique inner edges.

3. A circuit board connector according to claim 2, wherein said engagement protrusions each have a substantially semi-ellipsoidal configuration, said engagement hole having a substantially rhombic configuration.

4. A circuit board connector according to claim 2, wherein said engagement protrusions each have a substantially semi-circular sectional configuration, said engagement hole having a substantially elliptical configuration.

5. A circuit board connector according to claim 2, wherein said pair of flexible arms comprises a pair of cantilever-type arms, said engagement protrusions being formed on surfaces of said arms which face said terminal member.

6. A circuit board connector according to claim 2, wherein said pair of flexible arms comprises of a center-type arm having a slit, said engagement protrusions being formed respectively on either side of said slit so as to be opposed to each other.

7. A circuit board connector comprising:

a housing which is made of a resin material having a relatively large coefficient of thermal expansion; and at least one terminal member which is made of conductive material having a relatively small coefficient of thermal expansion and which is suitable for insertion into said housing and which extends through a bottom of said housing and suitable for soldering to a circuit conductor on a circuit board, said housing including at least a pair of flexible arms extending from upper to lower sections of said housing and arranged side by side with a gap therebetween, and engagement protrusions respectively provided on one surface of each of said pair of flexible arms at opposing positions for locking said terminal member, said terminal member having an engagement hole exhibiting at least a pair of oblique inner edges which are to be engaged with said engagement protrusions, said engagement protrusions being movable within said engagement hole while remaining in abutment with said oblique inner edges when said housing expands or contracts.

8. A circuit board connector according to claim 7, wherein said pair of arms are cantilever-type arms having a slit-like gap therebetween, said engagement protrusions consisting of substantially, semi-ellipsoidal protrusions which are provided on surfaces of said arms facing said terminal, at positions respectively on either side of said gap so as to be opposed to each other, said engagement hole being formed as a substantially rhombic hole whose four sides are symmetrical with respect to a vertical center line of said terminal member.

9. A circuit board connector according to claim 7, wherein said pair of arms are formed as a center-type arm having a slit, said engagement protrusions each being formed as protrusions having a substantially semi-circular sectional configuration and provided oppositely on either side of said slit, said engagement hole having a substantially elliptical configuration.

* * * * *